United States Patent [19]

Ohnishi

[11] Patent Number: 4,608,508

[45] Date of Patent: Aug. 26, 1986

[54] PIEZOELECTRIC IGNITER, ESPECIALLY FOR A CIGARETTE LIGHTER OR THE LIKE

[75] Inventor: Taiji Ohnishi, Himeji, Japan

[73] Assignees: Intermatch S.A., Nyon, Switzerland; K.K. Piem Riken, Himeji, Japan

[21] Appl. No.: 645,603

[22] Filed: Aug. 29, 1984

[51] Int. Cl.[4] ..... H01L 41/08

[52] U.S. Cl. ..... 310/339

[58] Field of Search ..... 310/338, 339; 361/260; 431/255

[56] References Cited

U.S. PATENT DOCUMENTS 3,729,639 4/1973 Heinouchi et al. ..... 310/339

3,829,737 8/1974 Johnsson ..... 310/339 X 4,139,792 2/1979 Kondo ..... 310/339

4,422,124 12/1983 Challet ..... 310/339 X

*Primary Examiner*—Mark O. Budd

*Attorney, Agent, or Firm*—Karl F. Ross; Herbert Dubno

[57] ABSTRACT

To facilitate assembly of a piezoelectric igniter the hammer is formed in one piece with diametrically opposite lugs and the interfitting parts of the spring-receiving sleeve and the casing containing the piezoelectric crystal activated by the hammer are of noncircular cross section with a major transverse dimension greater than the free end spacing of the lugs which is, in turn, greater than the inner window separation of the sleeve.

6 Claims, 7 Drawing Figures

PIEZOELECTRIC IGNITER, ESPECIALLY FOR A CIGARETTE LIGHTER OR THE LIKE

FIELD OF THE INVENTION

My present invention relates to a piezoelectric igniter, especially for a cigarette lighter or the like and, more particularly, to an igniter of the type in which a spring-loaded hammer is driven against an anvil bearing upon a piezoelectric crystal to generate a spark for ignition or other purposes upon relative displacement manually of two housing parts respectively provided with the spring mechanism and the anvil.

BACKGROUND OF THE INVENTION

Piezoelectric igniters which are manually actuatable generally comprise a spring-loaded hammer and an anvil juxtaposed with the hammer bearing against a piezoelectric crystal or other element, the output of which is applied across a pair of electrodes thereby generating a spark when the hammer, which is mechanically retained against the loading force, is instantaneously released.

Such piezoelectric igniters can be used in cigarette lighters to ignite a fuel such as butane which can be released by the mechanical movement that also ultimately triggers the formation of the spark.

The igniter with which the present invention is concerned generally comprises a female housing or sleeve which is closed at one end and receives the male member of the device, namely a casing whose outer configuration is cylindrical to mate with a cylindrical bore of the female member.

The casing, in succession from its external end toward the female member, is provided with a metallic anvil which may form one electrode in contact with the piezoelectric element, the piezoelectric element or crystal and a metallic abutment engaging the piezoelectric crystal from the opposite side.

Braced against the bottom of the female body within the latter and sealed against the inner end of the casing is a restoring spring which biases the female part and the casing away from one another against the manual actuation force.

Coaxial with this helical spring and forming an inner helical spring is another coil spring seated against the closed bottom of the female part of the housing and braced against a hammer which can be driven against the abutment in the manner previously described.

The hammer is formed with a pair of lateral projections defined by a pin extending through a transverse bore in the hammer to form diametrically opposite lugs each of which is received in a window formed in an adjacent portion of the wall of the female body and a longitudinal guide groove or slot formed in the casing. The inner end of the casing has a notch at the respective slot constituting a catch in which the respective lug is anchored, the lug being pushed into the catch by the action of a ramp provided in the transversal boundary or border of the window and against which the lug is applied by the action of the aforementioned springs.

From the notch the lug can be displaced by the action of another ramp inclined in the same sense but with inverse effect when the casing is pushed into the female part or the female part is pushed into casing by the manual action described. As the hammer is rotated to shift it out of the notch, the lugs are brought into line with the aforementioned slots and the drive spring, i.e. the inner one of the two springs, thus drives the hammer against the abutment to fire the spark. The actuating movement simultaneously compresses the spring so that the firing force applying the hammer against the piezoelectric element is enhanced.

In practice the transverse section of the cylindrical bore in the remale member and the external perimeter of the casing are circular which requires that the lugs be introduced after positioning of the hammer in the casing and in the female body and the application of the spring pressure.

This has, in the past, meant that the lugs were formed by a pin which was transversely inserted into a bore formed radially in the hammer.

This restriction of the hammer not only increases the cost of the device but also creates mounting and assembly problems which have not been satisfactorily resolved heretofore.

OBJECTS OF THE INVENTION

It is, therefore, the principal object of the present invention to provide an improved piezoelectric igniter whereby these disadvantages are obviated.

Another object of this invention is to provide a low-cost piezoelectric igniter which can make use of a one-piece hammer without detriment to the operating characteristics of the igniter.

It is also an object of this invention to provide a more reliable, inexpensive and efficiently operating piezoelectric igniter.

SUMMARY OF THE INVENTION

These objects and others which will become apparent hereinafter are attained, in accordance with the invention, by providing the interfitting parts of the female member and the casing with a transverse section that is noncircular and has a greatest dimension in one direction which exceeds the spacing between the windows in the female member and dimensions in other directions no greater than this spacing. The hammer, which can be formed unitarily with the lugs, has a cross-sectional dimension measured across the lugs that is less than the greater dimension but more than the distance separating the two windows.

Thus the hammer can be inserted into the bore ahead of the casing after the springs have been disposed in the sleeve with the greatest transverse dimension across the lugs of the hammer in substantially the same axial plane as the greatest transverse dimension of the bore and then rotated to swing its lugs into the respective windows. Since the separate mounting of the lugs and the hammer is no longer necessary, the lugs can be molded unitarily with the hammer and the manipulations required to inset a pin or the like can be eliminated.

The pivotal movement of the hammer, which can be cylindrical except for the lugs, takes place in a direction perpendicular to the planes of the windows when the lugs are pushed into the female member until they reach the level of the windows.

The engagement of the hammer in the female member can be realized simple by pushing it with the inner end of the casing into the bore and, after the hammer is in place, the lugs can be engaged in the notches of the respective slots into alignment with which the hammer is rotated once the lugs are in the windows. The lugs are thereby locked in place for use of the igniter in the manner described.

It has been found to be advantageous to provide the noncircular transverse sections of the bore and the complementary portions of the case with a double ogive shape, i.e. a double arch.

To rotate the hammer from its position in which its lugs are oriented in the direction of the greatest dimension of the bore of the female member into its internal operating position in which the lugs are engaged in the longitudinal windows of the female member and in the longitudinal slots of the casing, I provide a ramp on the inner end of each window or on the female member which effects the rotation as the hammer is pushed into place; the ramp or inclined edge can be located at the end of each longitudinal slot on the side thereof corresponding to the greatest dimension of the transverse section to rotate the hammer in the desired sense.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
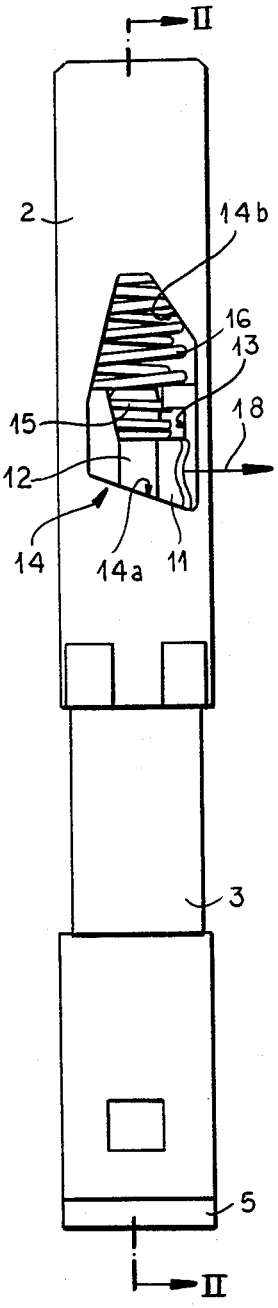
FIG. 1 is a side elevational view of an igniter according to the present invention.

As shown in the drawing, the piezoelectric igniter basically comprises a female housing member or sleeve 2 within which is slidably mounted a casing 3 whose end externally of the sleeve is closed by an anvil 4 carrying one of the electrodes 5 across which a spark is generated for ignition purposes; the other electrode, not shown, can be connected to the abutment 7 or on the sleeve 2.

The interior of the casing 3 contains, in a cylindrical bore 3', in succession, the anvil 4, a piezoelectric crystal or element 6 which is seated against the anvil 4 and the metal abutment 7 which rests against the piezoelectric element. Movement of the member 7 upwardly is prevented by an inwardly extending flange 8 of the casing 3 which engages a shoulder 7' of the 4' engaging in lateral openings 3'' of the casing. The transverse sections of the sleeve 2 and the casing 3 can be seen in FIGS. 3 and 6.

Figure 3:
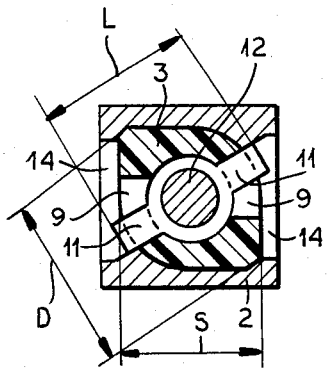
FIG. 3 is a transverse section taken along the line III—III of FIG. 2.

As shown in FIG. 3 the external perimeter of the sleeve 2 is square while the internal cross section of the casing 3 is circular.

However, the portion **3*a* of the casing 3 which is received in the sleeve, i.e. the portion extending beyond the abutment 7, has the external cross section of a double ogive or arch to fit complementarily into the bore 2*b* of the sleeve 2** which is of similar shape.

The inner extension **3*a* of the casing 3 is also formed with two diametrically opposite slots 9 serving as guides for a pair of planar lugs 11 molded unitarily on the hammer 12 which 12 which otherwise has a circular cylindrical form enabling it to slide in the interior of the casing 3 in the bore 3*b*** of the latter which is also of circular cylindrical configuration.

Figure 4:
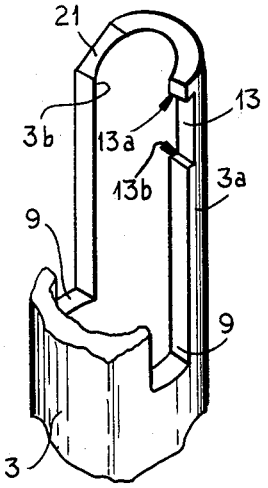
FIG. 4 is a partial perspective view of the end of the casig which is received in the complementary bore of the female member according to the invention.

As shown most clearly from FIG. 4, each longitudinal slot 9 of the casing 3 opens at the interior end of the casing and is formed, in the region of the end, with a lateral notch 13 having flanks **13*a* and 13*b* respectively close to the free end and spaced therefrom. The notch serves to retain a lug 11 of the hammer 12 and, when the lug 11 is lodged at the lowest portion of a window 14 formed in the sleeve, a spring presses the flank 13*a*** against the upper edge of the lug.

When the casing 3 is urged upwardly or the sleeve 2 is drawn downwardly, the flank **13*b* presses the hammer 12 upwardly until the hammer is rotated sufficiently to cause the lug 11 to swing out of the notch and allow the spring to drive the hammer down to the abutment 7 to initiate a discharge. Each notch 13 thus receives one of the lugs 11**.

The diametrically opposite windows 14 formed in opposite walls of the sleeve 2 each receives one of the lugs 11 projecting through and beyond a respective slot 9. Each window 14 is sufficiently large to cover the respective longitudinal slot 9 and its notch 13 so that the rotation of the hammer to engage in the notch and the slot is not interfered with.

The sleeve 2 also contains helicoidal (coil) springs 15 and 16 which are concentric or coaxial; the outer coil spring 16 is seated against the floor **2*a* of the sleeve and bears against the interior end of the casing, constituting a return spring, while the inner coil spring 15 seats against the floor 2*a* and is braced against the hammer 12** to form a loading spring.

Figure 5:
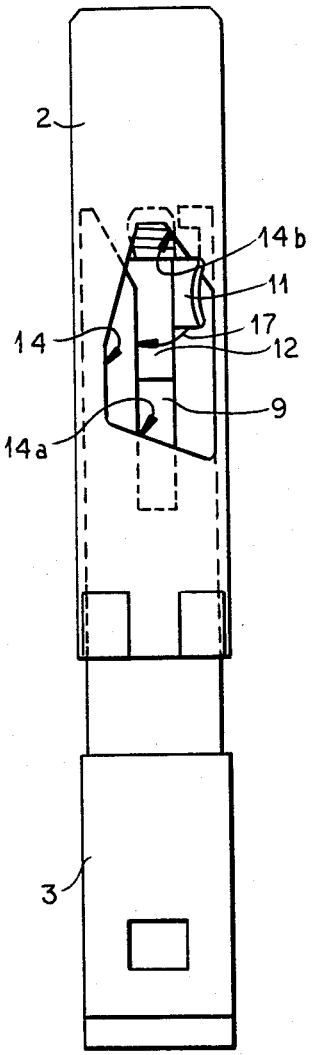
FIG. 5 is a view similar to FIG. 1 but showing the device in a different operative position.

As will be apparent from FIGS. 1 and 5, moreover, the transverse edges of each window 14 are inclined with respect to the longitudinal axis of the mechanism so as to form respective ramps **14*a* and 14*b* which effect, in turn, a camming of the lugs 11** engaged thereby into the respective notches and a camming of the respective lugs out of the notches. Thus these ramps, while inclined in the same sense, have inverse or opposite actions.

As seen from the drawing, the sleeve 2 is disposed above the casing 3 but this orientation is naturally solely for illustration purposes and any other disposition of the device is equally practical.

Apart from the mounting of the hammer in a manner which will be described subsequently, the device operates conventionally and as follows:

At rest and under the action of the springs 16 and 15 on the casing 3 and on the hammer 12, the lugs 11 are engaged in the notches 13 and the casing 3 assumes its greatest displacement out of the sleeve 2, a displacement limited by the engagement of the flank **13*a* against the upper edge of the respective lug 11 while the latter is at the lowest point of the window 14** into which it passes.

Figure 2:
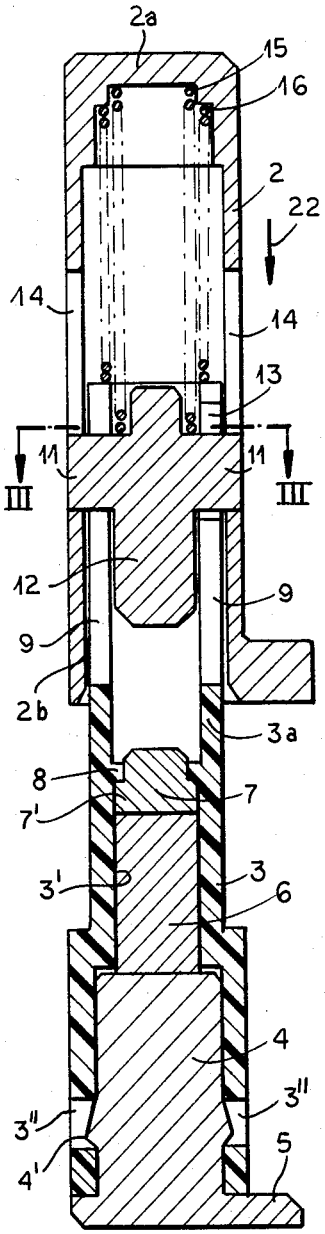
FIG. 2 is a sectional view taken along the line II—II of FIG. 1.

In the rest position shown in FIGS. 1 and 2, each lug thus rests at the low point of the ramp **14*a***.

As the casing 3 is pressed into the sleeve 2 the springs 15 and 16 are compressed and the flanks **13*b* lift the lugs 11 within the windows 14 until the lugs are engaged by the firing ramp 14*b* and thereby cammed in the direction of the arrow 17 out of the notch 13 in a rotary movement. The lugs 11 are then free to move along the slots 9 and are driven spontaneously in the direction by the compressed spring 16 projecting the hammer against the abutment 7 then generating a spark by the piezoelectric method. When the device is released or the force is relaxed, the spring 16 moves the casing downwardly with respect to the sleeve causing the ramp 14***a* to rotate the hammer in the opposite sense and bring the lugs 11 back into the notches. The lugs rest against the ramp 14*a* until the separation brings the notches into position to receive the lugs.

As noted earlier, the goal of the invention is to allow the lugs to be formed unitarily by a cast or forging operation and to thereby simplify assembly, make the device more reliable and, of course, reduce the cost price of the hammer and the unit as a whole.

Figure 6:
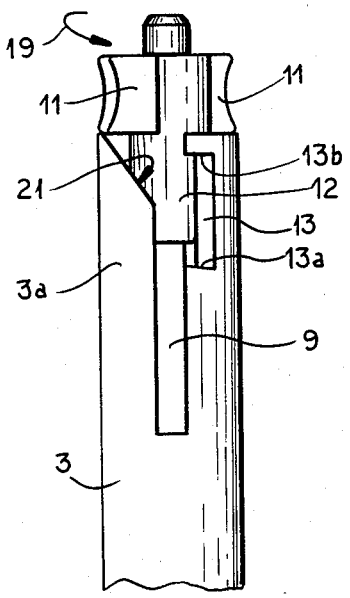
FIG. 6 is a view similar to FIG. 3 illustrating the position of a hammer during the mounting of the latter in the sleeve or female member.

As will be apparent from FIG. 3 and 6 the internal bore of the sleeve 2 and the external face of the casing 3 both are of double curve or double arch configuration in transverse cross section so as to have a major transverse dimension or diameter D corresponding to one of the diagonals of the square configuration of the sleeve as best seen in FIG. 3.

This dimension is much larger than the other transverse dimension.

The distance L separating the ends of the lugs is, as can also b seen from FIG. 3, less than the dimension diameter but greater than distance S separating the windowed faces of the sleeve, i.e. the distance between the inner faces of the walls of the sleeve 2 in which the windows 14 are formed.

Figure 7:
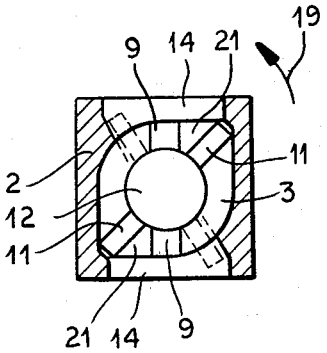
FIG. 7 is a transverse section illustrating the mounting of the hammer.

As a result of the configuration, the lugs 11 can be lined up with the major dimension D for insertion of the hammer ahead of the casing into the sleeve 2 (see FIG. 7) and then can be rotated through 90° in the sense of the arrow 19 to allow the lugs 11 to engage in the windows 14.

To facilitate the rotation of a hammer 12 when the lugs 11 reach the level of the windows, more or less automatically, the ends of the slots are formed with ramps 21 (see FIG. 4) on which the lugs are braced as the hammer is pushed by the casing into the sleeve. Before the window level is reached, the noncircular configuration of the bore of the spring prevents dropping of the lugs into the slots, but once the lower window edges are passed the lugs are free to rotate and thus automatically fall into the slots.

The spring 15 thereby presses the hammer 12 and its lugs 11 against the edge 14*a* of the respective window and, as the casing is pushed further up in the sleeve, the lugs swing into the respective notches 13. The mechanism is than ready to generate a spark in the manner described.

It should be obvious also that the mounting of the mechanism can be effected automatically mechanically without manual intervention, thereby further reducing the fabrication cost.

I claim:

1. A piezoelectric igniter comprising:

a sleeve formed with a pair of peripherally closed windows at opposite sides thereof and having a noncircular generally oval internal cross section having arcuate portions, said internal cross section having a major transverse dimension;

a casing shiftable relative to said sleeve and having an interior portion of noncircular outer cross section complementary to that of said sleeve and received therein, said casing being formed with a pair of diametrically opposite slots open at respective ends within said sleeve and provided adjacent said ends with respective notches;

at least one compression spring received in said sleeve; a hammer formed unitarily with a pair of diametrically opposite lugs projecting through said windows and biased by said spring toward said casing, said lugs being guided in said slots and engageable in said notches; and a piezoelectric assembly disposed in said casing adapted to be impacted by said hammer upon release of said lugs from said notches by camming rotation of said hammer relative to said casing and said sleeve by an inclined edge of at least one of said windows, a further inclined edge of one of said windows camming said lugs into said notches, said major dimension being greater than the free end spacing of said lugs which is less than the distance between internal surfaces of said sleeve formed with said windows.

2. A piezoelectric igniter comprising:

a sleeve formed with a pair of windows at opposite sides thereof and having a noncircular internal cross section having a major transverse dimension;

a casing shiftable relative to said sleeve and having an interior portion of noncircular outer cross section complementary to that of said sleeve, said casing being formed with a pair of diametrically opposite slots open at respective ends within said sleeve and provided adjacent said ends with respective notches;

at least one compression spring received in said sleeve;

a hammer having a pair of diametrically opposite lugs projecting through said windows and biased by said spring toward said casing, said lugs being guided in said slots and engageable in said notches; and a piezoelectric assembly disposed in said casing adapted to be impacted by said hammer upon release of said lugs from said notches by camming rotation of said hammer relative to said casing and said sleeve by an inclined edge of at least one of said windows, a further inclined edge of one of said windows camming said lugs into said notches, said major dimension being greater than the free end spacing of said lugs which is less than the distance between internal surfaces of said sleeve formed with said windows, the internal cross section of said sleeve receiving said casing and the external cross section of said casing received in said sleeve are of double ogive configuration.

3. The igniter defined in claim 2 wherein said sleeve is formed adjacent said notches with a pair of ramps engaging said lugs for urging said hammer into said sleeve against the face of said spring whereby said hammer rotates when said ramps reach the level of said windows to cause said lugs to enter said slots and engage automatically in said notches.

4. The igniter defined in claim 3, further comprising another spring coaxial with the first-mentioned spring, seated against said sleeve and bearing upon an end of said casing extending into said sleeve.

5. The igniter defined in claimed 4 wherein said assembly comprises an anvil in said casing remote from said sleeve, a piezoelectric crystal braced against said anvil, and an abutment engaging said piezoelectric crystal and juxtaposed with said hammer.

6. The igniter defined in claim 5 wherein said hammer is formed with said lugs in single piece.

* * * * *